US011235566B2

(12) United States Patent
Chung

(10) Patent No.: US 11,235,566 B2
(45) Date of Patent: Feb. 1, 2022

(54) ROTARY SCREEN TRANSFER PRINTING MACHINE AND CONTROL SYSTEM

(71) Applicants: Newtech Textile Technology Development (Shanghai) Co., LTD, Shanghai (CN); Po-Wen Chung, Shanghai (CN)

(72) Inventor: Po-Wen Chung, Shanghai (CN)

(73) Assignee: NEWTECH TEXTILE TECHNOLOGY DEVELOPMENT (SHANGHAI) CO., LTD, Shanghai (CN)

( * ) Notice: Subject to any disclaimer, the term of this patent is extended or adjusted under 35 U.S.C. 154(b) by 265 days.

(21) Appl. No.: 16/613,650

(22) PCT Filed: May 21, 2018

(86) PCT No.: PCT/CN2018/087671
§ 371 (c)(1),
(2) Date: Nov. 14, 2019

(87) PCT Pub. No.: WO2019/001172
PCT Pub. Date: Jan. 3, 2019

(65) Prior Publication Data

US 2020/0180301 A1 Jun. 11, 2020

(30) Foreign Application Priority Data

Jun. 28, 2017 (CN) ..... 201710504252.1

(51) Int. Cl.
*B41F 33/16* (2006.01)
*B41F 15/10* (2006.01)
(Continued)

(52) U.S. Cl.
CPC ..... *B41F 15/38* (2013.01); *B41F 13/0045* (2013.01); *B41F 13/025* (2013.01);
(Continued)

(58) Field of Classification Search
None
See application file for complete search history.

(56) References Cited

U.S. PATENT DOCUMENTS 3,934,505 A 1/1976 Kushner
4,238,999 A 12/1980 Giani et al.
(Continued)

FOREIGN PATENT DOCUMENTS

CN 101164778 A 4/2008
CN 201950945 U 8/2011
(Continued)

OTHER PUBLICATIONS

International Search Report issued in application No. PCT/CN2018/087671.
(Continued)

*Primary Examiner* — Leslie J Evanisko
(74) *Attorney, Agent, or Firm* — McClure, Qualey & Rodack, LLP

(57) ABSTRACT

A rotary screen transfer printing machine and a control system thereof. The rotary screen transfer printing machine having a feeding unit, a printing unit, a drying unit, and a receiving unit; the printing unit has at least one rotary screen transfer printing assembly and a guide belt assembly; each rotary screen transfer printing assembly has a rotary screen plate roller and a transfer roller; the rotary screen plate roller is close to the transfer roller; the transfer roller is seamlessly
(Continued)

coated with rubber or a resin having good affinity for a water-based ink. A control system includes: a motion controller; a conveying synchronization module, used for controlling the feeding unit, the printing unit, the drying unit, and the receiving unit to synchronize the conveying speeds of the four units; and a rotary screen transfer printing synchronization module.

15 Claims, 2 Drawing Sheets

(51) Int. Cl.

| | |
|---|---|
| ***B41F 15/12*** | (2006.01) |
| ***B41F 13/004*** | (2006.01) |
| ***B41F 15/38*** | (2006.01) |
| ***B41F 17/00*** | (2006.01) |
| ***B41F 17/38*** | (2006.01) |
| ***B41F 13/02*** | (2006.01) |
| ***B41F 23/04*** | (2006.01) |
| ***B41F 15/08*** | (2006.01) |
| ***B41F 33/00*** | (2006.01) |

(52) U.S. Cl.
CPC ..... *B41F 15/08* (2013.01); *B41F 15/0836* (2013.01); *B41F 15/12* (2013.01); *B41F 17/003* (2013.01); *B41F 17/38* (2013.01); *B41F 23/04* (2013.01); *B41F 23/0426* (2013.01); *B41F 33/0009* (2013.01); *B41F 33/0081* (2013.01); *B41F 33/16* (2013.01)

(56) References Cited

U.S. PATENT DOCUMENTS

| | | | | |
|---|---|---|---|---|
| 4,366,542 | A * | 12/1982 | Anselrode ..... | B41F 33/16 101/116 |
| 6,041,705 | A | 3/2000 | Lintner | |
| 2008/0092758 | A1 | 4/2008 | Numauchi et al. | |

FOREIGN PATENT DOCUMENTS

| | | | |
|---|---|---|---|
| CN | 102267284 | B | 6/2015 |
| CN | 206231040 | U | 6/2017 |
| CN | 206231041 | U | 6/2017 |
| EP | 0244034 | A1 | 11/1987 |
| EP | 0396924 | A2 | 11/1990 |
| GB | 2271744 | A | 4/1994 |
| JP | 2014-176979 | A | 9/2014 |
| NL | 7812604 | A | 7/1980 |

OTHER PUBLICATIONS

Search Report accompanying the counterpart application's office action, issued by EPO dated Feb. 22, 2021.

* cited by examiner

ROTARY SCREEN TRANSFER PRINTING MACHINE AND CONTROL SYSTEM

BACKGROUND

Technical Field

The present disclosure relates to printing and dyeing machines for use in the textile industry, and more particularly to a rotary screen transfer printing machine and a control system thereof.

Related Art

There are many types of printing and dyeing processes and machines. At present, the main printing processes on the market include rotary screen printing, flat screen printing, roller printing, bedplate printing, transfer printing, digital ink-jet printing, etc. The rotary screen printing is a printing mode in which a color paste in a rotary screen is printed on a fabric by using a scraper under a pressure, which has the advantages of high production efficiency of the roller printing, and also has the characteristics of large pattern printing and rich color of the flat screen printing. The rotary screen printing is recognized as a printing process between the roller printing and the flat screen printing, which has a major breakthrough and development in a printing technology. Once launched, the rotary screen printing has spread rapidly and has a high application ratio in printing enterprises.

However, in practical applications, the applicant has found that one of the problems of the conventional rotary screen printing machine is that, when printing fine patterns or lines, due to the limitation of a mesh structure of a rotary screen itself and due to poor pressure tolerance and deformation resistance of the rotary screen itself, the effect of printing fine lines is not very satisfactory.

In addition, another problem of the rotary screen printing machine is that, it is not possible to achieve plate alignment quickly and the plate alignment effect cannot meet the increasing demands. As with other printing processes, in order to achieve printing accuracy, the rotary screen printing machine needs to maintain position synchronization between rotary screens during the printing process to achieve correct color registration or plate alignment. If the plate alignment is not accurate, an overlapping degree of color patterns printed by each color group of the rotary screen printing machine is not high enough, and defect products are produced, thereby affecting the productivity and production efficiency of the printing machine. At present, some printing equipment is logically controlled by manual operations. Not only the operation is complicated and the plate alignment error is large, but also the dynamic adjustment speed is low, further affecting the productivity and production efficiency of the printing machine. In the traditional mechanical coaxial transmission control, there are many transmission links to cause large accumulated errors, thereby affecting the printing accuracy. With the mechanical wear, it is prone to have "misalignment", which affects the stability of the printing quality. In addition, the variety adaptability is limited and it is not suitable for processing heavy structures ($\geq 180$ g/cm$^2$).

Although advanced printing technologies for printing fine patterns on paper have been widely developed and applied in the field of printing, such printing technologies are limited to paper in practical applications. Since the physical and chemical properties of fabrics are quite different from those of paper, simply transferring a paper printing technology directly to fabric printing presents a number of problems.

SUMMARY

Therefore, the present disclosure is directed to a control system for a rotary screen transfer printing machine, which can solve at least one of the above problems in the prior art. The entire control system for the rotary screen transfer printing machine has a simple and direct structure, better stability, has low requirements for a control technology, and can be easily developed.

According to an aspect of the present disclosure, a control system for a rotary screen transfer printing machine is provided. The rotary screen transfer printing machine includes a feeding unit, a printing unit, a drying unit, and a receiving unit. The feeding unit is configured to feed a fabric to the printing unit. The drying unit is configured to dry the printed fabric. The receiving unit is configured to receive the printed fabric into a product cloth basket. The printing unit includes at least one rotary screen transfer printing assembly and a guide belt assembly. Each rotary screen transfer printing assembly includes a rotary screen plate roller and a transfer roller. The rotary screen plate roller is close to the transfer roller. A surface of the transfer roller is seamlessly coated with rubber or resin having good affinity for a water-based ink. The control system includes:

- a Motion controller;
- a conveying synchronization module, being configured to control the feeding unit, the printing unit, the drying unit, and the receiving unit to synchronize conveying speeds of the four units; and
- a rotary screen transfer printing synchronization module, being configured to control phase synchronization between an annular guide belt and the rotary screen transfer printing assembly and phase synchronization between the rotary screen transfer printing assemblies to ensure registration or alignment accuracy;
- wherein the Motion controller is connected to each module through a field bus.

Preferably, the Motion controller sets a reference speed, calculates given speeds of respective driving motors of the feeding unit, the printing unit, the drying unit, and the receiving unit based on the reference speed, and sends corresponding signals indicating the given speeds to the conveying synchronization module, so as to control the corresponding units to convey a to-be-printed fabric at the corresponding given speeds, thereby ensuring speed synchronization between the feeding unit, the printing unit, the drying unit, and the receiving unit as a whole.

Preferably, the Motion controller sets a reference speed, calculates given speeds of driving motors of the annular guide belt and each rotary screen transfer printing assembly based on the reference speed, and sends corresponding signals indicating the given speeds to the rotary screen transfer printing synchronization module, so as to control the respective driving motors to run at the corresponding given speeds, thereby achieving phase synchronization between the annular guide belt and the rotary screen transfer printing assembly and phase synchronization between the rotary screen transfer printing assemblies.

Preferably, the reference speed is a conveying speed of the annular guide belt in the printing unit.

Preferably, the drying unit includes a hot air motor, and the control system includes a fan control module configured to control an air volume of the hot air motor according to a conveying speed of the fabric, so as to keep a hot air temperature in the drying unit constant.

Preferably, the control system includes a tension control module, which achieves tension closed-loop feedback control by controlling a tension roller according to a real-time tension of the fabric detected by a tension sensor, so as to maintain a proper tension.

Preferably, the tension control module includes a first tension roller located between the feeding unit and the printing unit and a second tension roller located between the drying unit and the receiving unit.

Preferably, the rotary screen transfer printing synchronization module includes a plurality of sub-modules disposed in correspondence to the rotary screen transfer printing assemblies respectively, each sub-module includes a corresponding servo driver configured to control the driving motor of the corresponding rotary screen transfer printing assembly, and each servo driver communicates with the Motion controller through the field bus.

Preferably, each sub-module is capable of adjusting the phase of the corresponding rotary screen transfer printing assembly according to a registration deviation distance obtained by detecting a color patch through a detector.

Preferably, the detector is a color patch sensor, and one color patch sensor is disposed downstream of each rotary screen transfer printing assembly.

Preferably, the detector is a camera, which is disposed at a suitable position of a cloth discharging end of the printing unit. The camera captures an image of the fabric, sends the captured image to the Motion controller for quantization and segmentation, extracts all color batches, and then calculates, by taking the centroid of a first color batch as an origin point, a distance between the centroids of the other color batches and the origin point, so as to obtain a registration deviation distance of other colors with respect to a first color.

Preferably, the rotary screen transfer printing synchronization module includes an image detection device located at a cloth discharging end of each rotary screen transfer printing assembly, the image detection device captures a printed pattern in real time, the Motion controller processes the captured image, extracts a feature value, compares the feature value with a standard reference value to obtain a coordinate position deviation, and then converts the deviation into a printing deviation amount of the corresponding rotary screen transfer printing assembly, and based on the deviation amount, the rotary screen transfer printing synchronization module sends a compensation signal to the driving motor of the corresponding rotary screen transfer printing assembly for real-time correction, thereby achieving automatic registration control.

Preferably, the image detection device is a camera.

Preferably, the Motion controller processes the captured image as follows:

(1) image preprocessing: performing digitization, gray transformation, gray balance and filter denoising operations on a collected image so that the image is suitable for post processing and information of interest to the image is enhanced, and information of no interest is also inhibited;

(2) image segmentation: performing binary threshold segmentation on the preprocessed image, then refining the binarized image by morphologic processing, and extracting a pattern skeleton for recognition processing; and (3) image analysis and recognition: performing skeleton extraction on the binarized image, selecting several feature points from the image to obtain a feature value, and comparing the feature value with a standard reference value to obtain a coordinate position deviation, so as to obtain an accurate printing error, and the printing error is a deviation amount of the corresponding rotary screen transfer printing assembly.

According to another aspect of the present disclosure, a rotary screen transfer printing machine is provided, which includes the above control system.

Preferably, the rotary screen transfer printing assembly includes a back pressure roller arranged opposite to the transfer roller, and the annular guide belt and the fabric pass between the back pressure roller and the transfer roller.

Preferably, the diameter of the transfer roller is the same as that of the rotary screen plate roller or is an integral multiple of that of the rotary screen plate roller.

Preferably, the surface of the transfer roller has a Shore hardness of 70 to 85 degrees.

Other objects, features, and details of the present disclosure will become fully apparent with reference to the following detailed description of exemplary embodiments and the accompanying drawings and in accordance with the appended claims.

A person skilled in the art should understand the advantages of the embodiments and various additional embodiments by reading the following detailed description of the embodiments with reference to the corresponding accompanying drawings listed below. In addition, various features of the accompanying drawings discussed below are not necessarily drawn to scale. Dimensions of various features and elements in the accompanying drawings may be expanded or reduced to more clearly illustrate the embodiments of the present disclosure.

BRIEF DESCRIPTION OF THE DRAWINGS

The present disclosure is further described with reference to the accompanying drawings and the embodiments, and a same reference label refers to similar or the same elements throughout the accompanying drawings and the descriptions of the accompanying drawings.

DETAILED DESCRIPTION

Figure 1:
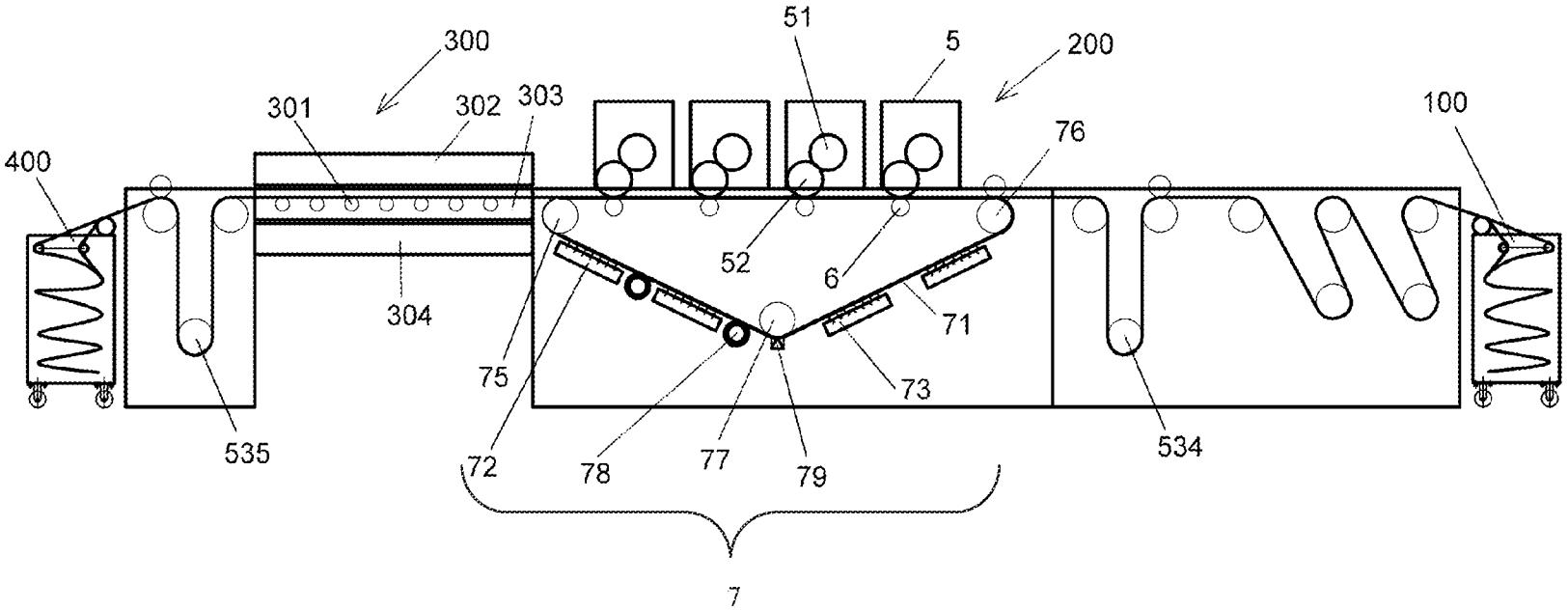
FIG. 1 is an overall schematic view of a rotary screen transfer printing machine according to an embodiment of the present disclosure.

Various illustrative embodiments of the present disclosure are described below. In this specification, various systems, structures, and devices are schematically depicted in the accompanying drawings for purposes of explanation only, but all features of actual systems, structures, and devices such as well-known functions or structures are not described in detail to avoid unnecessary details that obscure the present disclosure. Certainly, it should be understood that in any practical application, many specific implementation decisions need to be made to achieve the specific goals of developers or users, the specific goals may vary according to the actual application, and the system-related and industry-related restrictions need to be followed. In addition, it should be understood that such specific implementation decisions, while complex and time consuming, are routine tasks for those of ordinary skill in the art who benefit from the present disclosure.

The terms and phrases used herein should be understood and interpreted as having a meaning consistent with the understanding of these terms and phrases by those skilled in the relevant art. The consistent usage of terms or phrases herein is not intended to imply a particular definition of terms or phrases, that is, a definition that is different from an ordinary and customary meaning understood by those skilled in the art. For terms or phrases intended to have a special meaning, that is, a meaning different from what a skilled person understands, the special definition will be explicitly listed in the specification in a defined manner, and the special definition of terms or phrases will be given directly and unequivocally.

Unless required by the content, in the entire specification and claims below, the word "include/comprise" and its variants, such as "including", are to be interpreted in an open, inclusive sense, that is, "including but not limited to".

Throughout the description of this specification, the description of the reference terms such as "an embodiment", "one embodiment", "some embodiments", "example", "specific example", or "some examples" means that the specific features, structures, materials or characteristics described with reference to the embodiment or example are included in at least one embodiment or example of the present disclosure. Therefore, the phrase such as "in one embodiment" or "in an embodiment" that appears in different places throughout the specification does not necessarily refer to the same embodiment. Moreover, the specific features, structures, materials, or characteristics described may be combined in any one or more embodiments or examples in an appropriate manner.

As used in this specification and the appended claims, unless otherwise specified and limited, the singular form of the indefinite article "a" and the definite article "the" include one or more reference objects. It should also be noted that, unless otherwise specified and limited, the term "or" generally includes "and/or" in terms of meaning. For the purposes of explanation, a phrase in the form of "A or B" means "(A), (B) or (A and B)". For the purpose of explanation, a phrase in the form of "at least one of A, B, or C" means "(A), (B), (C), (A and B), (A and C), (B and C), or (A, B, and C)".

Moreover, the terms "first", "second", and the like are used for descriptive purposes only and are not to be construed as indicating or implying a relative importance or implicitly indicating the number of technical features indicated. Therefore, features defined by "first", "second", and the like may include one or more of the features, either explicitly or implicitly. In the description of the present disclosure, unless otherwise specifically defined, "a plurality of" means two or more.

The system described herein may also utilize one or more controllers to receive information and transform the received information to generate an output. The controller may include any type of computing device and computing circuit, or any type of processor or processing circuit capable of executing a series of instructions stored in a memory. The controller may include a plurality of processors and/or multi-core central processing units (CPU) and may include any type of processor, such as a micro processing unit, a digital signal processor, and a micro control unit. The controller may also include a memory for storing data and/or algorithms to execute a series of instructions.

Figure 2:
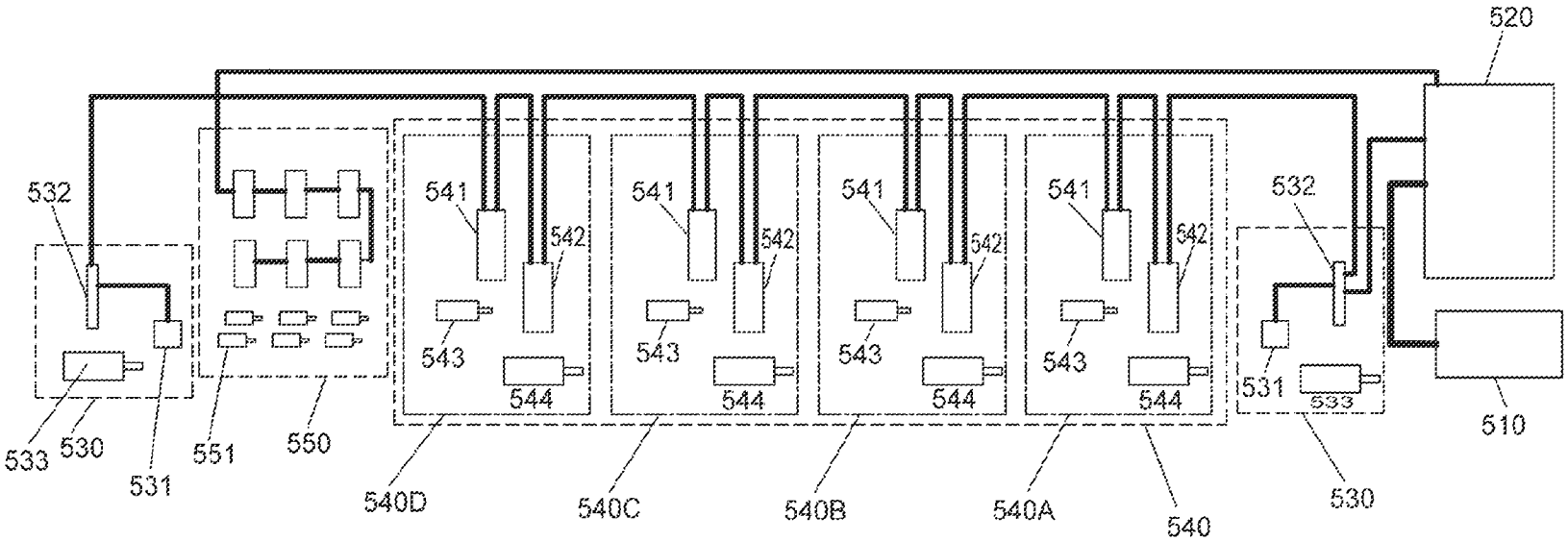
FIG. 2 is a schematic view of a control system for a rotary screen control printing machine according to an embodiment of the present disclosure.

According to an embodiment of the present disclosure, a rotary screen transfer printing machine is provided as shown in FIG. 1 as a whole. The rotary screen transfer printing machine may include the following parts: a feeding unit 100, a printing unit 200, a drying unit 300, and a receiving unit 400. The arrangement order of the units may be as shown in FIG. 1. FIG. 2 illustrates a schematic view of a control system for a rotary screen transfer printing machine. As shown in FIG. 2, the control system may include a human machine interface (HMI) 510, a Motion controller 520, a field bus, various control modules, various sensors, and the like. The HMI 510 collects signals such as user key operations, vehicle speed control and stop modes. An operator sends an instruction to the Motion controller 520 through the HMI 510 to uniformly manage and control the units, thereby implementing automatic control.

The printing unit 200 may include at least one rotary screen transfer printing assembly 5, a back pressure roller 6, and a guide belt assembly 7. A plurality of rotary screen transfer printing assemblies 5 may be installed within a length range of a frame according to color registration or color overlapping demands for printing. Preferably, four, six and eight rotary screen transfer printing assemblies are installed.

Each rotary screen transfer printing assembly 5 includes a rotary screen plate roller 51, a transfer roller 52, and a scraper. The rotary screen plate roller 51 is close to the transfer roller 52, and a gap therebetween is 0.3±0.1 mm. The diameter of the transfer roller 52 is the same as that of the rotary screen plate roller 51, or is an integral multiple of that of the rotary screen plate roller. A surface of the transfer roller is seamlessly coated with rubber or resin, preferably, rubber or resin having good affinity for a water-based ink. The surface of the transfer roller may have a Shore hardness of 70 to 85 degrees, preferably, 80 degrees. The traditional rotary screen printing process is that a rotary screen directly contacts a fabric to transfer color patterns. When printing fine patterns or lines, due to the limitation of a mesh structure of the rotary screen itself as well as poor pressure tolerance and deformation resistance of the rotary screen itself, the effect of printing fine lines is not very satisfactory. The present disclosure employs transfer printing, i.e., transfer of a rotary screen pattern ink to the surface of the transfer roller coated with rubber or resin by the contact of the rotary screen plate roller and the transfer roller, and then transfers printing to the fabric by the embossing of the fabric on the surface of the transfer roller and the annular guide belt. Since the transfer roller may be pressed against the fabric, a printing pattern is perfectly presented on the fabric.

Each rotary screen transfer printing assembly 5 is independently driven by a driving motor, preferably, a servo motor. The Motion controller is connected to a servo driver of each servo motor through the field bus, thereby achieving high-accuracy synchronous control of each rotary screen transfer printing assembly. A pre-register function may be implemented by the servo motor and the Motion controller, thereby greatly reducing material waste.

The rotary screen plate roller 51 and the transfer roller 52 may be driven in a double-servo driving mode, that is, the rotary screen plate roller 51 and the transfer roller 52 are both driven by an independent servo motor, and the double-servo driving mode is shown in FIG. 2. A single-servo driving mode may be adopted, that is, one of the rotary screen plate roller 51 and the transfer roller 52 is driven by a servo motor, and the other one is driven to rotate by the servo motor through gear transmission.

The back pressure roller 6 and the transfer roller 52 are arranged opposite to each other, and the guide belt 71 and the fabric pass therebetween. The back pressure roller 6 is a metal roller or a rubber roller.

The guide belt 7 may include an annular guide belt 71, a transmission system, a cleaning device 72, and a guide belt drying device 73. The transmission system includes driving rollers and driven rollers. The numbers and positions of the driving rollers and the driven rollers may be flexibly arranged as needed. In the embodiment shown in FIG. 1, three rollers are disposed, wherein front and rear separation parts of the annular guide belt 71 in contact with the fabric are separately disposed with one roller, one of the two rollers is a driving roller such as a roller 75, and the other roller is a driven roller 76. A third roller 77 is disposed below the center of the two rollers, the third roller being also a driven roller for tensioning the annular guide belt. Each of the back pressure roller 6, the driving roller 75, and the driven rollers 76, 77 are wrapped in an inner wall of the annular guide belt 71. The cleaning device 72 and the guide belt drying device 73 are located on the outer side of the annular guide belt 71, as shown in FIG. 1. The cleaning device 72 is configured to clean the ink which may remain on the annular guide belt after penetrating through the fabric during the printing process. Preferably, the cleaning device is a water spray cleaning device. A brush 78 is disposed downstream of the water spray cleaning device. A wiping device 79 is preferably disposed between the cleaning device 72 and the guide belt drying device 73. The guide belt drying device 73 is configured to dry the surface of the cleaned guide belt. The guide belt drying device may be an infrared drying device and/or a hot air drying device, preferably, an infrared drying device.

The feeding unit 100 is configured to feed a fabric to the printing unit 200. The receiving unit 400 is configured to receive the printed fabric into a product cloth basket. A traction device may be disposed between the feeding unit 100 and the printing unit 200, and/or a traction device may be disposed between the printing unit 200 and the receiving unit 400.

The drying unit 300 is configured to dry the printed fabric. According to an embodiment of the present disclosure, the drying unit 300 includes a drying passage 303, a carrier roller 301, and hot air blowers. The drying passage 303 may be an elongated chamber formed by a drying passage upper layer 302 and a drying passage lower layer 304. The printed fabric passes through the drying passage by the support of the carrier roller 301 located in the drying passage 303. A plurality of hot air blowers is arranged in the drying passage upper layer and the drying passage lower layer. The hot air blowers are driven by a hot air motor and configured to blow hot air to the drying passage.

Referring to FIG. 2, the control system for the rotary screen transfer printing machine will be described in more detail below. As shown in the figure, the HMI 510, the Motion controller 520, the drivers of the servo motors, a driver of the hot air motor, a tension sensor, a temperature sensor (not shown), and the like of the control system are connected by the field bus. According to different control objectives, the control system may include the following modules: a conveying synchronization module (not labeled), a tension control module 530, a rotary screen transfer printing synchronization module 540, and a fan control module 550. These modules all communicate with the Motion controller 520 which is equivalent to a central control unit to implement respective control functions. The conveying synchronization module is configured to control conveying speeds of the feeding unit, the printing unit (in particular, the annular guide belt), the drying unit, and the receiving unit to synchronize the conveying speeds of the four units. The tension control module 530 is configured to control a tension roller 534 to achieve tension closed-loop feedback control, so as to maintain a proper tension. The rotary screen transfer printing synchronization module 540 is configured to control position (phase) synchronization between the annular guide belt and the rotary screen transfer printing assembly and position (phase) synchronization between the rotary screen transfer printing assemblies to ensure registration or alignment (plate alignment) accuracy.

The fan control module 550 is configured to control an air volume of a hot air motor 551 (see FIG. 2) according to a conveying speed of the fabric, so as to keep a hot air temperature in the drying unit constant. The Motion controller gives a control signal according to a fabric speed, and the control signal corresponds to a predetermined temperature in the drying passage 303. A temperature sensor (not shown) is further disposed in the drying passage, measures a real-time temperature of hot air in the drying passage, and sends the real-time temperature to the Motion controller. The Motion controller controls the speed of the hot air motor 551 of the hot air blower based on the real-time temperature, thereby maintaining the temperature in the drying passage 303 constant, and achieving temperature PID control.

In a rotary screen control system, two synchronization problems are mainly to be solved. The first one is speed synchronization between the feeding unit, the printing unit (i.e., the belt guide assembly), the drying unit, and the receiving unit. The synchronization therebetween ensures that the fabric is neither stretched and even broken, nor wound, when passing through the four units successively. The synchronization is implemented by the conveying synchronization module, which sets a motor as a reference motor, uses the speed of the reference motor as a reference speed, and calculates given speeds of other motors with the reference speed, so as to ensure speed synchronization between the feeding unit, the printing unit, the drying unit, and the receiving unit as a whole, thereby ensuring the uniform action coordination and printing accuracy of the entire rotary screen transfer printing machine. In essence, the above setting step is equivalent to that the Motion controller sets a reference speed, and calculates given speeds of respective driving motors of the feeding unit, the printing unit, the drying unit, and the receiving unit based on the reference speed.

In particular, according to an embodiment of the present disclosure, a conveying speed of the annular guide belt 71 in the printing unit 200 is used as a reference speed, and the Motion controller calculates a set speed of the driving motor of each unit based on the reference speed, and sends a signal indicating the corresponding set speed to each driving motor, so as to control each driving motor to run at the corresponding set speed, thereby operating the four units in speed synchronization. Herein, the driving motor of the driving roller 75 in the guide belt assembly 7, preferably the servo motor, is used as a reference motor, and the speeds of other motors are calculated according to a reference speed of the reference motor, so that when the fabric passes through the units or components driven by the motors, a consistent linear speed can be maintained. The Motion controller sends a signal indicating the reference speed to the reference motor, and sends signals indicating corresponding set speeds calculated based on the reference speed to other motors. The other motors may include a driving motor of the feeding unit, a servo motor of the rotary screen transfer printing assembly (in a double-servo driving mode, a rotary screen servo motor and a transfer servo motor; in a single-servo driving mode, a servo motor shared by the rotary screen plate roller and the transfer roller), a driving motor of the carrier roller in the drying unit, a driving motor of the receiving unit and the like, as well as a driving motor of each traction roller.

In addition, as described above, in order to avoid the situation that the tension of the fabric is not suitable during the conveying process, the control system also achieves tension closed-loop feedback control by the tension control module 530. The tension sensor 531 detects a real-time tension of the fabric and feeds back a tension signal to the Motion controller. The Motion controller calculates an adjustment amount through the feedback signal, and sends a signal to a tension servo driver 532 to control a corresponding tension roller servo motor 533, thereby adjusting the tension of the fabric by the tension roller servo motor to maintain a suitable tension.

The tension control module may control a tension state of the fabric throughout the printing process, so that the fabric is neither stretched and even broken, nor wound during the entire printing process. In this printing machine, both the cloth feeding tension and the cloth discharging tension can be effectively controlled. According to an embodiment of the present disclosure, the tension control module 530 includes a first tension roller 534 located between the feeding unit and the printing unit and a second tension roller 535 located between the drying unit and the receiving unit (as shown in FIG. 1). Alternatively or additionally, an additional tension roller may be disposed between the printing unit and the drying unit. Thus, the rotary screen transfer printing machine according to the present disclosure divides the tension control into the following sections: tension control before transfer printing and tension control after transfer printing. In each section, the real-time tension is detected by the tension sensor, and the Motion controller controls the corresponding tension roller servo motor through each servo driver to achieve tension closed-loop control. The magnitude of the tension in each section may be set as needed to meet the requirements of different fabric materials.

The second synchronization is phase synchronization of the printing unit, that is, position synchronization between the rotary screen transfer printing assemblies 5 and position synchronization between the annular guide belt 71 and the rotary screen transfer printing assemblies 5. This is important for ensuring the printing accuracy, which is usually alignment, registration, or plate alignment. The phase synchronization is achieved by the above rotary screen transfer printing synchronization module.

According to the embodiment of the present disclosure, the rotary screen transfer printing synchronization module uses the conveying speed of the annular guide belt, that is, the speed of the servo motor of the driving roller as a reference speed, and the Motion controller calculates a set speed of the driving motor of each rotary screen transfer printing assembly 5 based on the reference speed, and sends a signal indicating the corresponding set speed to each driving motor, so as to control each driving motor to run at the corresponding set speed, thereby achieving synchronization between the annular guide belt 71 and each rotary screen transfer printing assembly 5. First, the Motion controller controls a servo motor (not shown) of the driving roller 75 of the annular guide belt to run accurately at a set speed to ensure smooth conveying of the fabric on the annular guide belt. Then, the Motion controller uses the speed of the servo motor of the driving roller as a reference speed to calculate a set speed corresponding to each rotary screen transfer printing assembly 5, and the Motion controller controls the servo motor of each rotary screen transfer printing assembly at the set speed to ensure phase synchronization between the annular guide belt and each rotary screen transfer printing assembly, thereby ensuring accurate transfer printing of a pattern of each transfer printing assembly onto the fabric.

In addition, in order to compensate a speed error to achieve absolute angle and position synchronization and to eliminate the influences of motor drift and accumulated displacement, the rotary screen transfer printing synchronization module also introduces an alignment (registration) signal, which may automatically adjust a synchronization error.

In the embodiment shown in FIG. 2, the rotary screen transfer printing synchronization module 540 according to the embodiment of the present disclosure includes a plurality of sub-modules disposed in correspondence to the rotary screen transfer printing assemblies 5 respectively (four sub-modules 540A, 540B, 540C, and 540D are shown in the figure). Each sub-module may include a corresponding servo driver configured to control the servo motor of each rotary screen transfer printing assembly. In the illustrated embodiment, each sub-module includes a servo driver 542 for a servo motor 544 of the transfer roller 52 and a servo driver 541 for a servo motor 543 of the rotary screen plate roller 51. Each servo driver communicates with the Motion controller through the field bus. Each sub-module is capable of adjusting the positions of the transfer roller and the rotary screen plate roller of the corresponding rotary screen transfer printing assembly according to a registration deviation distance obtained by detecting a color patch through a detector.

The color patch is printed when the fabric passes through each rotary screen transfer printing assembly, for example, via a mark disposed on the rotary screen plate roller of the rotary screen transfer printing assembly. The printed color patches may be in one-to-one correspondence with the rotary screen transfer printing assemblies. For example, if four rotary screen transfer printing assemblies are disposed in printing equipment, one color patch may be printed correspondingly each time the fabric passes through each rotary screen transfer printing assembly, and for the four rotary screen transfer printing assemblies, four color patches of different colors are printed. The form of the printed color patches may be rectangular, triangular, trapezoidal or cross-shaped, etc. Moreover, adjacent color patches may have a predetermined reference distance D0 (e.g., 0 mm, 5 mm, or 10 mm, etc., of course, not limited thereto). In an embodiment, a detector (e.g., a photoelectric sensor) disposed in correspondence to each rotary screen transfer printing assembly may detect a passing color patch corresponding to the rotary screen transfer printing assembly 5. For example, the detector disposed in association with a second rotary screen transfer printing assembly 5 may detect a second color patch that is just printed and corresponding to the second rotary screen transfer printing assembly 5. Then, a distance D1 between the second color patch and a first color patch (which may be referred to as a primary color patch) corresponding to a first rotary screen transfer printing assembly 5 may be obtained, and then the above reference distance D0 is compared with the distance D1 to obtain a registration deviation distance A1 of the second rotary screen transfer printing assembly 5, which may be used as a difference therebetween. The detection of color patches corresponding to other rotary screen transfer printing assemblies and the calculation of the registration deviation distance are similar to the manner described above with reference to the second color patch, except that the current reference distance is a multiple of the above reference distance. For example, when the registration deviation distance of a third rotary screen transfer printing assembly 5 is calculated, the current reference distance is twice of the color patch reference distance, i.e., 2×D0. Based on the registration deviation distance of the corresponding rotary screen transfer printing assembly calculated by the above manner, the positions of the transfer roller and the rotary screen plate roller of the corresponding rotary screen transfer printing assembly may be dynamically adjusted in real time, thereby automatically registering the rotary screen transfer printing assemblies, that is, achieving automatic plate alignment or registration.

For example, in the case of D0=0 mm, a first color patch corresponding to a first color printed by the first rotary screen transfer printing assembly is used as a standard, and the registration deviation distances of other colors are distances between color patches corresponding to corresponding colors of other rotary screen transfer printing assemblies and the first color patch. For example, the second color patch is 5 mm (+5) behind the first color patch, indicating that the second rotary screen transfer printing assembly is 5 mm behind the standard first rotary screen transfer printing assembly, such that it is necessary to adjust the phase of the second rotary screen transfer printing assembly based on the distance to achieve phase synchronization between the second rotary screen transfer printing assembly and the first rotary screen transfer printing assembly (which may be referred to as "accelerating"), and then the previous conveying speed synchronization is recovered. This process is very fast, only in a few microseconds, with little effect on the overall conveying of the fabric. Specific operations for accelerating may be performed in a manner known in the art. In contrast, if the second color patch is 5 mm (−5) in front of the first color patch, indicating that the second rotary screen transfer printing assembly is 5 mm ahead of the standard first rotary screen transfer printing assembly, such that it is necessary to adjust the phase of the second rotary screen transfer printing assembly based on the distance to achieve phase synchronization between the second rotary screen transfer printing assembly and the first rotary screen transfer printing assembly (which may be referred to as "decelerating"), and then the previous conveying speed synchronization is recovered. Specific operations for decelerating may be performed in a manner known in the art.

In an alternative embodiment of the present disclosure, the camera may also be used to capture an image of the fabric at a suitable position of the cloth discharging end of the printing unit, wherein the fabric has been printed with all of the color patches, including, in the illustrated embodiment, four color patches of different colors. The Motion controller quantizes and segments the image captured by the camera. Since the colors of the color patches are different, it is quite easy to extract each color batch. Then, by taking the centroid of a first color batch as an origin point, a distance between the centroids of the other color batches and the origin point is calculated, so as to obtain a registration deviation distance of other rotary screen transfer printing assemblies with respect to the first rotary screen transfer printing assembly or a registration deviation distance of other colors with respect to a first color. Based on the registration deviation distance of the corresponding rotary screen transfer printing assembly, the positions of the transfer roller and the rotary screen plate roller of the corresponding rotary screen transfer printing assembly may be dynamically adjusted, thereby automatically registering the rotary screen transfer printing assemblies, that is, achieving automatic plate alignment or registration.

In still another alternative embodiment of the present disclosure, an image processing technology may also be applied to the alignment detection of the printing unit for detecting a pattern of the printed fabric in real time, feeding back a signal to the corresponding rotary screen transfer printing assembly and forming unmarked alignment detection. The camera captures an image of a printing pattern that is just printed in real time at the cloth discharging end of each rotary screen transfer printing assembly, the captured image are sent to the Motion controller for processing and a feature value is extracted. A feature value in a first frame of image (i.e., an image of a first color, the first color is often the main color which is a color block having a larger area, so a pattern outline is substantially clear, and a reference standard of subsequent colors may be conveniently determined) corresponding to the first rotary screen transfer printing assembly is stored as a standard reference value. A next frame of image captured by the camera at the cloth discharging end of the second rotary screen transfer printing assembly is sent to the Motion controller for the same processing to obtain a feature value of this frame of image. The feature value is compared with the aforementioned standard reference value to obtain a deviation of a coordinate position, the deviation is converted into a printing deviation amount of the corresponding rotary screen transfer printing assembly, and a compensation signal is sent to the servo motor of the rotary screen transfer printing assembly based on the deviation amount for real-time correction, thereby achieving automatic alignment control. The pattern printed on a third rotary screen transfer printing assembly, a fourth rotary screen transfer printing assembly, and the like is processed in the same manner.

An algorithm for image processing is divided into three steps:

(1) Image preprocessing: digitization, gray transformation, gray balance and filter denoising operations are performed on a collected image, mainly for making the image suitable for post processing, enhancing information of interest to the image, and also inhibiting information of no interest.

(2) Image segmentation: a feature value is extracted by using an image processing technique, wherein binary threshold segmentation is performed on the preprocessed image, then refining the binarized image is performed by morphologic processing, and a pattern skeleton is extracted for recognition processing.

(3) Image analysis and recognition: skeleton extraction is performed on the binarized image, several feature points are selected from the image to obtain a feature value, and the feature value is compared with a standard reference value to obtain a coordinate position deviation, so as to obtain an accurate printing error, and the printing error is a deviation amount of the corresponding rotary screen transfer printing assembly.

According to an embodiment, the Motion controller 520 may select a high-performance motion synchronization controller of Baumüller PLC02Motion (or PCC04) or Rexroth MLC45 (MLC65), so that a multi-axis servo drive may achieve precise synchronization control in a dynamic process. It may also be a motion controller of Yaskawa MP series. According to an embodiment, the field bus may select Ethercat and CanOpen buses. The CanOpen bus is configured to connect the driver of the hot air motor; the Ethercat is configured to connect the drivers of a tension control servo motor, a servo motor of the transfer roller, and a servo motor of the rotary screen plate roller.

It should be understood by those skilled in the art that although the above embodiments all use the conveying speed of the annular guide belt as a reference speed, the speed of other corresponding units or components of the rotary screen transfer printing machine may also be used as the reference speed.

According to the control system for the rotary screen transfer printing machine disclosed by the present disclosure, an all-digital Motion controller is used as a master station, a servo driver and other control devices, etc. are used as slave stations, the running states of all the connected control devices are fed back in real time to the HMI through the field bus connection, the system may also be expanded to the Internet connection so as to establish the foundation for enterprise management and remote maintenance.

The rotary screen transfer printing machine of the present disclosure is suitable for high-speed printing production, and the annular guide belt transmission achieves, by the servo motor, stepless speed regulation at any speed. In operation, a deviation can be controlled in real time. Even in the process of accelerating and decelerating, synchronous operation can be performed. There is no "misalignment" phenomenon, and the alignment accuracy is high (≤=+/−0.15-0.2 mm). The precise tension control also minimizes the tensile deformation of the fabric and satisfies printing of different varieties to achieve the best printing effect. The dynamic characteristics of the rotary screen transfer printing motor control are improved to cause a faster response property. A bus motion controller is used to better achieve synchronous control. The present disclosure introduces an alignment (registration) signal to automatically eliminate an overprint deviation.

The present disclosure may include any feature, combination of features, or a summary thereof that are implicitly or explicitly disclosed herein, and is not limited to any of the limitations listed above. Any element, feature and/or structural arrangement described herein may be combined in any appropriate manner.

The specific embodiments disclosed above are exemplary only, and it is apparent to those skilled in the art who benefit from the teachings herein that the present disclosure may be modified and implemented in a different but equivalent manner. For example, the method steps described above may be performed in a different order. In addition, the details of the structure or design shown herein are not limited except as described in the following claims. Therefore, it is apparent that changes and modifications may be made to the specific embodiments disclosed above, and all such variations are considered to fall within the scope and spirit of the present disclosure.

What is claimed is:

1. A control system for a rotary screen transfer printing machine, the rotary screen transfer printing machine comprising a feeding unit, a printing unit, a drying unit, and a receiving unit, the feeding unit being configured to feed a fabric to the printing unit, the drying unit being configured to dry the printed fabric, and the receiving unit being configured to receive the printed fabric into a product cloth basket, wherein the printing unit comprises at least two rotary screen transfer printing assemblies and a guide belt assembly, each of the at least two rotary screen transfer printing assemblies comprises a rotary screen plate roller and a transfer roller, the rotary screen plate roller is close to the transfer roller, and a surface of the transfer roller is seamlessly coated with rubber or resin having good affinity for a water-based ink, the control system is configured to control the feeding unit, the printing unit, the drying unit, and the receiving unit to synchronize conveying speeds of the four units and comprises:

a Motion controller; and a rotary screen transfer printing synchronization module, being configured to control phase synchronization between an annular guide belt and each of the at least two rotary screen transfer printing assemblies and phase synchronization between the at least two rotary screen transfer printing assemblies to ensure registration or alignment accuracy, wherein the Motion controller is connected to each module.

2. The control system according to claim 1, wherein the Motion controller sets a reference speed, calculates given speeds of respective driving motors of the feeding unit, the printing unit, the drying unit, and the receiving unit based on the reference speed, so that the control system controls the corresponding units to convey a to-be-printed fabric at the corresponding given speeds, thereby ensuring speed synchronization between the feeding unit, the printing unit, the drying unit, and the receiving unit as a whole.

3. The control system according to claim 1, wherein the Motion controller sets a reference speed, calculates given speeds of driving motors of the annular guide belt and the at least two rotary screen transfer printing assemblies based on the reference speed, and sends corresponding signals indicating the given speeds to the rotary screen transfer printing synchronization module, so as to control the respective driving motors to run at the corresponding given speeds, thereby achieving phase synchronization between the annular guide belt and the at least two rotary screen transfer printing assemblies and phase synchronization between the at least two rotary screen transfer printing assemblies.

4. The control system according to claim 2, wherein the reference speed is a conveying speed of the annular guide belt in the printing unit.

5. The control system according to claim 1, wherein the drying unit comprises a hot air motor, and the control system comprises a fan control module configured to control an air volume of the hot air motor according to a conveying speed of the fabric, so as to keep a hot air temperature in the drying unit constant.

6. The control system according to claim 1, wherein the control system comprises a tension control module, the tension control module achieves tension closed-loop feedback control by controlling a tension roller according to a real-time tension of the fabric detected by a tension sensor, so as to maintain a proper tension.

7. The control system according to claim 6, wherein the tension control module comprises a first tension roller located between the feeding unit and the printing unit and a second tension roller located between the drying unit and the receiving unit.

8. The control system according to claim 1, wherein the rotary screen transfer printing synchronization module comprises a plurality of sub-modules disposed in correspondence to the at least two rotary screen transfer printing assemblies respectively, each sub-module comprises a corresponding servo driver configured to control the driving motor of the corresponding rotary screen transfer printing assembly, and each servo driver communicates with the Motion controller.

9. The control system according to claim 8, wherein each sub-module is capable of adjusting the phase of the corresponding rotary screen transfer printing assembly according to a registration deviation distance obtained by detecting a color patch.

10. The control system according to claim 8, wherein the rotary screen transfer printing synchronization module comprises an image detection device located at a cloth discharging end of each of the at least two rotary screen transfer printing assemblies, the image detection device captures an image of a printed pattern in real time, the Motion controller processes the captured image, extracts a feature value, compares the feature value with a standard reference value to obtain a coordinate position deviation, and then converts the deviation into a printing deviation amount of the corresponding rotary screen transfer printing assembly, and based on the printing deviation amount, the rotary screen transfer printing synchronization module sends a compensation signal to the driving motor of the corresponding rotary screen transfer printing assembly for real-time correction, thereby achieving automatic registration control.

11. The control system according to claim 1, wherein the Motion controller processes following steps to an image captured by the control system:

(1) image preprocessing: performing digitization, gray transformation, gray balance and filter denoising operations on a collected image so that the image is suitable for post processing and information of interest to the image is enhanced, and also information of no interest is inhibited;

(2) image segmentation: performing binary threshold segmentation on the preprocessed image, then refining the image being binarized by morphologic processing, and extracting a pattern skeleton for recognition processing; and (3) image analysis and recognition: performing skeleton extraction on the binarized image, selecting several feature points from the image to obtain a feature value, and comparing the feature value with a standard reference value to obtain a coordinate position deviation, so as to obtain an accurate printing error, and the printing error is a deviation amount of each of the at least two rotary screen transfer printing assemblies.

12. A rotary screen transfer printing machine, comprising the control system according to claim 1.

13. The rotary screen transfer printing machine according to claim 12, wherein each of the at least two rotary screen transfer printing assemblies comprises a back pressure roller arranged opposite to the transfer roller, and the annular guide belt and the fabric pass between the back pressure roller and the transfer roller.

14. The rotary screen transfer printing machine according to claim 12, wherein the diameter of the transfer roller is the same as that of the rotary screen plate roller or is an integral multiple of that of the rotary screen plate roller.

15. The rotary screen transfer printing machine according to claim 12, wherein the surface of the transfer roller has a Shore hardness of 70 to 85 degrees.

* * * * *